US007048259B2

(12) United States Patent
Quaintance et al.

(10) Patent No.: US 7,048,259 B2
(45) Date of Patent: May 23, 2006

(54) RAIL BRACKET MOUNTING SYSTEM WITH LOCKING PIN

(75) Inventors: Randy R. Quaintance, York, NE (US); Ronald R. West, Alpine, UT (US)

(73) Assignee: Kroy Building Products, Inc., York, NE (US)

( * ) Notice: Subject to any disclaimer, the term of this patent is extended or adjusted under 35 U.S.C. 154(b) by 57 days.

(21) Appl. No.: 10/165,177

(22) Filed: Jun. 6, 2002

(65) Prior Publication Data

US 2003/0030048 A1 Feb. 13, 2003

Related U.S. Application Data

(63) Continuation of application No. 10/039,234, filed on Dec. 31, 2001, now abandoned, and a continuation of application No. 09/919,502, filed on Jul. 31, 2001, now abandoned, and a continuation-in-part of application No. 09/844,846, filed on Apr. 28, 2001, now abandoned.

(51) Int. Cl.
*E04H 17/14* (2006.01)

(52) U.S. Cl. ..... 256/65.06; 256/59; 256/65.02; 256/65.03; 256/65.04; 256/65.07

(58) Field of Classification Search ..... 256/19, 256/21, 24, 59, 65.01–65.08, 65.16
See application file for complete search history.

(56) References Cited

U.S. PATENT DOCUMENTS

| | | | | |
|---|---|---|---|---|
| 859,239 | A * | 7/1907 | McFall | 256/57 |
| 2,336,385 | A | 12/1943 | Batcheller | |
| 2,590,929 | A | 4/1952 | Bush | |
| 3,107,900 | A | 10/1963 | De Paolo | |
| 3,156,282 | A | 11/1964 | Bedford, Jr. | |
| 3,208,778 | A | 9/1965 | Gordon | |
| 3,212,754 | A | 10/1965 | Revell et al. | |
| 3,278,149 | A | 10/1966 | Brucker | |
| 3,385,567 | A | 5/1968 | Case et al. | |
| 3,498,589 | A | 3/1970 | Murdock et al. | |
| 3,506,243 | A | 4/1970 | Seiler | |
| 3,752,262 | A * | 8/1973 | Helms | 182/113 |
| 4,101,226 | A | 7/1978 | Parisien | |

(Continued)

FOREIGN PATENT DOCUMENTS

CA 1035983 8/1978

OTHER PUBLICATIONS

Declaration of John T. Forbis Regarding Non-Documentary Information Publicly Available Prior to Earliest Filing Date.

*Primary Examiner*—Daniel P. Stodola
*Assistant Examiner*—Michael P. Ferguson
(74) *Attorney, Agent, or Firm*—Clayton, Howarth & Cannon, P.C.

(57) ABSTRACT

A rail bracket mounting system, including a bracket that is attached to a post. The bracket is formed to support the notching of a rail. The end of a rail is then nested into the bracket, and is supported by the bracket. The rail is then secured to the bracket by fasteners such as screws, and a cover may then be placed over the bracket, housing the securing fasteners. The rail may be hollow or solid. A hollow rail may be reinforced along its entire length by the insertion of one or more reinforcing members through a hollow portion of the rail.

36 Claims, 7 Drawing Sheets

U.S. PATENT DOCUMENTS 4,114,861 A * 9/1978 Long ..... 256/67
4,124,198 A 11/1978 Wong
4,135,837 A 1/1979 Suttles
4,165,944 A 8/1979 Sunasky
4,280,686 A 7/1981 Wack
4,368,875 A 1/1983 Weiss et al.
4,369,953 A 1/1983 Greiner et al.
4,616,950 A 10/1986 Morris
4,625,948 A 12/1986 Lustvee
4,667,935 A * 5/1987 Moore ..... 256/22
4,856,252 A 8/1989 Cornell
4,919,394 A 4/1990 Otte et al.
4,923,176 A 5/1990 Heinz
4,958,399 A 9/1990 Toal et al.
5,101,540 A 4/1992 Roof et al.
5,143,472 A 9/1992 Reed et al.
5,186,571 A 2/1993 Hentzschel
5,215,290 A 6/1993 Khalessi
5,437,433 A 8/1995 Rezek
5,441,241 A 8/1995 McKim
5,474,279 A 12/1995 Parisien
5,544,865 A 8/1996 Abbaticchio
5,547,169 A 8/1996 Russell
5,564,248 A 10/1996 Callies
5,695,174 A * 12/1997 Tsai ..... 256/22
5,755,431 A 5/1998 Williams
5,788,224 A 8/1998 Platt
5,795,503 A 8/1998 Krake
5,873,671 A * 2/1999 West ..... 403/232.1
5,938,184 A 8/1999 DeSouza
5,961,242 A * 10/1999 Leone ..... 403/234
5,964,452 A 10/1999 Summers
5,967,498 A 10/1999 Junell
5,971,365 A 10/1999 Pigott et al.
6,017,019 A 1/2000 Erwin
6,029,954 A 2/2000 Murdaca
6,039,307 A 3/2000 De Zen
6,053,481 A 4/2000 Scheide
6,131,358 A 10/2000 Wise
6,173,944 B1 1/2001 McCarthy
6,308,937 B1 10/2001 Pettit
6,398,193 B1 6/2002 DeSouza
6,601,831 B1 * 8/2003 Erwin ..... 256/65.05
2002/0000545 A1 * 1/2002 Pettit et al. ..... 256/19

* cited by examiner

RAIL BRACKET MOUNTING SYSTEM WITH LOCKING PIN

CROSS-REFERENCE TO RELATED APPLICATIONS

This application is a continuation of U.S. patent application Ser. No. 10/039,234, filed Dec. 31, 2001 now abandon, entitled "Rail Bracket Mounting System," which is incorporated herein by reference in its entirety and which is a continuation of U.S. patent application Ser. No. 09/919,502, filed Jul. 31, 2001 now abandon, entitled "Rail Bracket Mounting System," which is incorporated herein by reference in its entirety and which is a continuation-in-part of U.S. patent application Ser. No. 09/844,846, filed Apr. 28, 2001 now abandon, entitled "Rail Bracket Mounting System," which is incorporated herein by reference in its entirety, including but not limited to those portions that specifically appear hereinafter.

STATEMENT REGARDING FEDERALLY SPONSORED RESEARCH OR DEVELOPMENT

Not Applicable

BACKGROUND OF THE INVENTION

1. The Field of the Invention

The present invention relates generally to a rail attachment bracket system, and more particularly, but not entirely, to a rail attachment bracket system that provides a uniquely effective attachment of a fence rail to a fence post.

2. Description of Related Art

It is a common practice to construct fencing from a system of vertical posts connected by horizontal rails to which pickets are attached. Commonly, these pieces are attached to each other with nails, screws, or nuts and bolts. These fasteners have a small surface area of contact against the piece fastened, resulting in a connection that may be insecure or easily disconnected. Such fasteners also protrude from the fence and can pose a safety risk by contact with the skin, resulting in cuts and abrasions. To attach a rail to a post using these conventional fasteners requires that the rail be separately supported until the rail is secured to the post. A user is thus required to use a separate means to support the rail, before screwing or belting the rail to the post. This is laborious and time consuming.

Attempts have been made in the prior art to provide alternatives to the conventional fasteners. U.S. Pat. No. 5,873,671, granted Feb. 23, 1999 to West (herein after the "'671 patent") discloses a rail attachment bracket with a snap on cover. The '671 bracket consists of a internal support member that is attached to a vertical post, and the open end of a hollow rail is slipped over the internal support member of the bracket. The rail may be secured to the internal support, and a snap-on cover is placed over the rail and internal support connection.

One advantage of the '671 bracket is that once the rail is installed on the bracket, the bracket provides independent support to the rail. Another advantage is that when the rail is secured to the bracket, the fasteners are then covered by the snap-on cover and concealed from view for a more aesthetically pleasing look. However, the rail is supported internally and without any external support. This both limits the bracket to use with a hollow rail with an adequately large opening and also places the weight of the rail against the inside of the top wall of the rail. If additional pressure is placed on the rail, the top wall can fail, requiring the rail to be replaced. The internal support also interferes with the placement of longitudinal reinforcing structure inside the rail.

Reinforcement means for a hollow fence rail have been commonly provided by placing a metal rod within the fence rail, such that the rod extends throughout the entire length of the rail. Such a fence rail is attached to the posts by aligning the protruding end of the metal rod with an opening in the post, and thereafter securing the rail to the post with screws. This arrangement still requires the user to provide separate support for the rail until the attachment is secured, and leaves the head of the screws exposed. It also requires the user to align the rail to the post so the rod may enter the opening.

It is noteworthy that none of the prior art known to applicant provides a rail bracket system capable of holding the rail in position for attachment to the post, without requiring separate support of the rail to accomplish the attachment.

The prior art is thus characterized by several disadvantages that are addressed by the present invention. The present invention minimizes, and in some aspects eliminates, the above-mentioned failures, and other problems, by utilizing the methods and structural features described herein.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
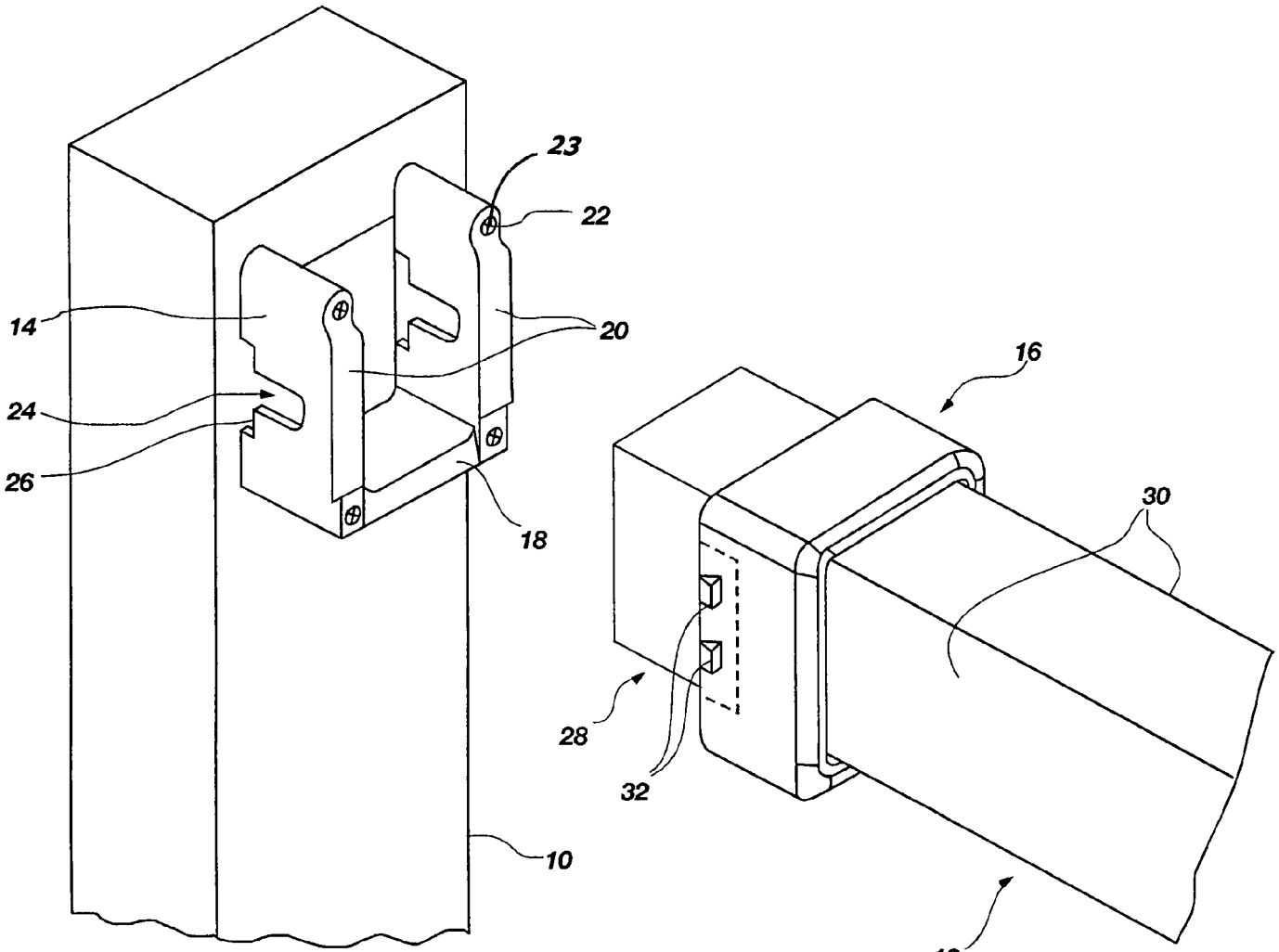
FIG. 1 is a perspective, break-away view of a rail bracket mounting system made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
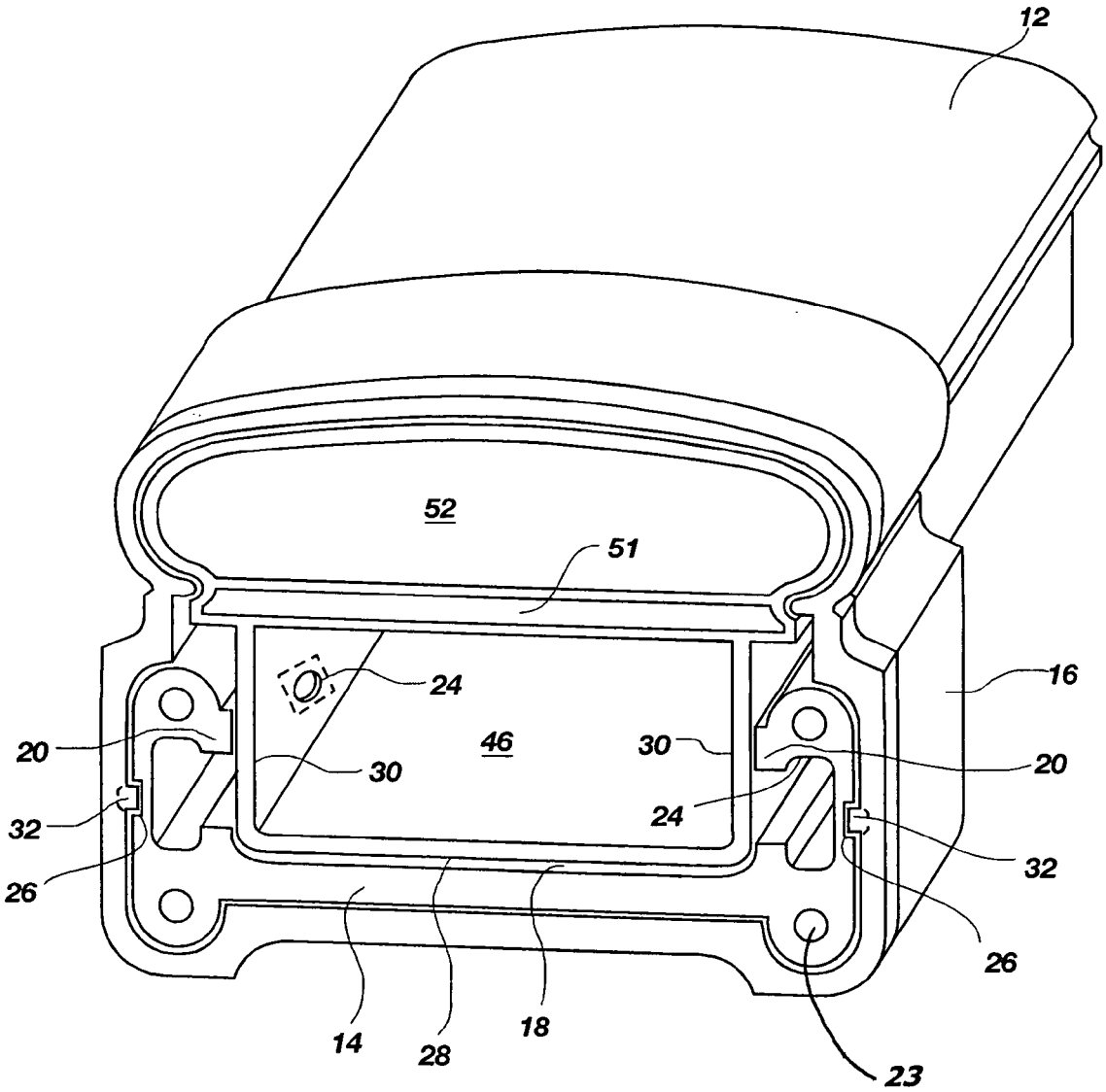
FIG. 2 is a frontal view of another embodiment of a rail bracket mounting system of made in accordance with the principles of the present invention.
Figure 3:
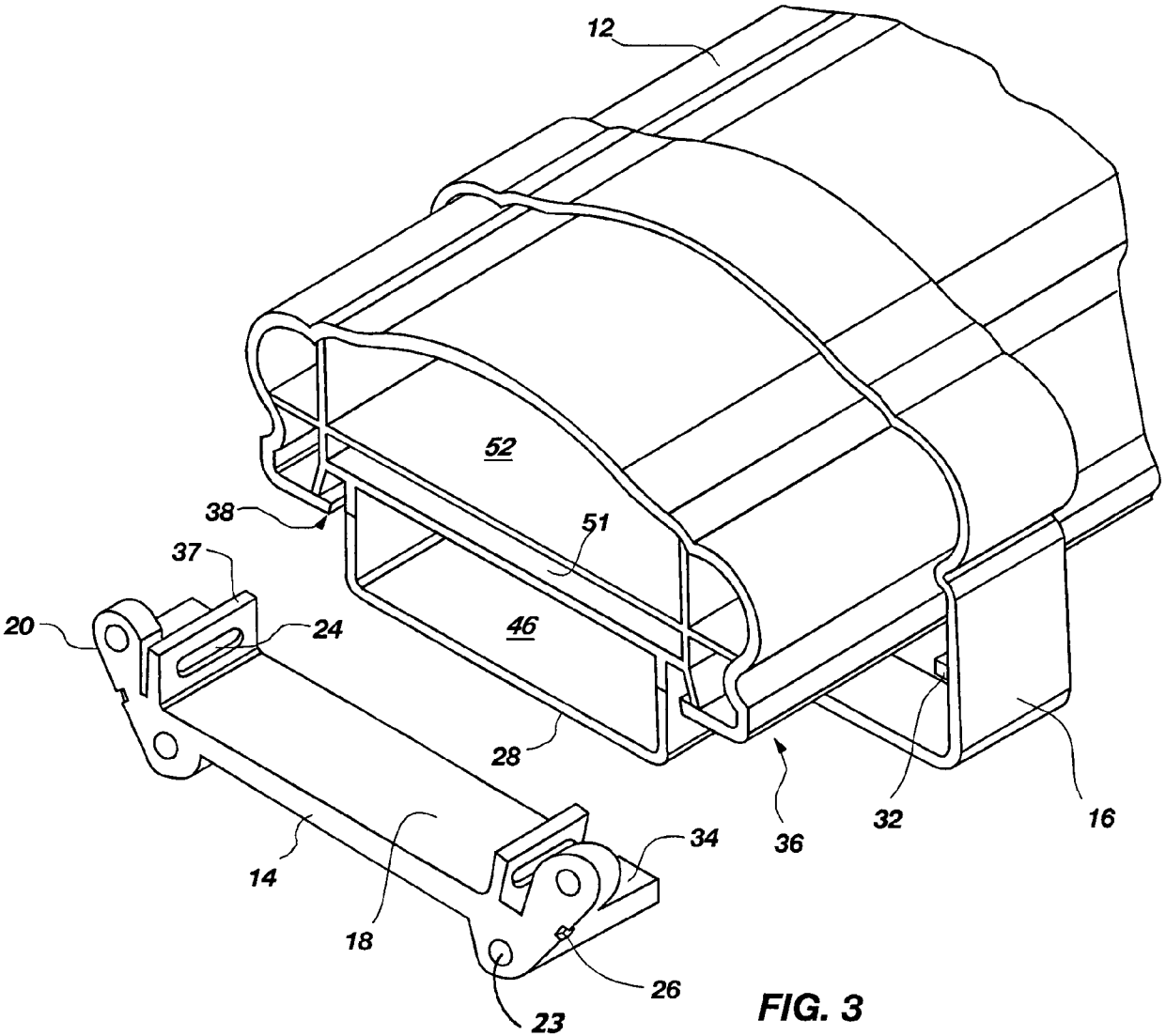
FIG. 3 is a perspective, break-away view of another embodiment of a rail bracket mounting system, made in accordance the principles of the present invention.

The invention is directed to a system for attaching fence members together with a bracket. FIGS. 1–3 show some of the possible embodiments of the invention. The support bracket 14 is attached to the post 10, also sometimes referred to herein as a fence rail support. In the embodiment shown in FIG. 1, the bracket has been attached by screws 22 inserted in through-bores 23, but any suitable method to attach the bracket 14 to the post 10, such as nails, bolts, or the use of a chemical adhesive will suffice. Note that in the embodiments of FIGS. 2, 3, and 4 the post 10 is not shown in order to more clearly show the rail bracket mounting system. In one preferred embodiment, the post is a PVC fence post, but any post constructed of suitable material will suffice. The bracket 14 features a bottom ledge 18 which is constructed to support the weight of a rail. Rail 12 is placed into the bracket 14. In the preferred embodiment, the rail 12 is placed into two brackets 14, one at each end of the rail 12. This allows the rail to be cut to the exact length needed. When the rail 12 is placed into the bracket, the bottom wall 28 of the rail 12 is placed on top of the bottom ledge 18, and the side walls 30 of the rail 12, lie adjacent to at least a portion of the side supports 20 of the bracket 14. The rail 12 is thus "nested" in the bracket. It will be appreciated that any number of alternative shapes for the rail 12 and bracket 14 are possible, including a rail 12 that is cylindrical or octagonal in shape, or a rail having a decorative portion above the bracket, among many others, with a bracket 14 that is similarly configured. In any embodiment the bracket 14 preferably supports the rail 12 at least in part from a point on the bottom surface 28 of the rail. It will be appreciated that all such variations of the shape of the rail 12 and bracket 14 are within the scope of the present invention.

It will be appreciated that in some preferred embodiments, the side supports 20 of the bracket 14 are configured to help support the rail 12. The side supports 20 may also be configured to secure the rail 12 in the bracket 14. This is most clearly demonstrated by the embodiment shown in FIG. 3. The side supports 20 of this embodiment include a flat surface 34 and a ridge 37. When the rail 12 is nested in the bracket 14, the sidewalls 30 of the rail are held between the ridges 37. The top surface of the ridges 37 enter a channel 38 on the rail 12 acting to secure the rail in the bracket. Optionally, the rail 12 may be configured to engage in an interference fit with the bracket, for example by modification of the channel and ridge structure that is depicted in FIG. 3. The side supports 20, of the embodiment of FIG. 3 also feature a flat surface 34. When the rail 12 is nested in the bracket 14, the flat surface 34 lies underneath a corresponding bottom side surface 36 on the rail 12, providing additional support for the rail. It will be appreciated that other configurations of the bracket 14, including the side supports 20 and the rail 12, including structures for interacting with the bracket 14 so as to be secured in the bracket 14 or supported by the side supports 20, are readily ascertainable to those skilled in the art, from the teachings herein and are included within the scope of the present invention.

When the rail 12 is nested in the bracket 14, the bracket holds and supports the rail. If the rail 12 is nested in a bracket 14 at both ends, the rail 12 is completely supported against downward vertical displacement. Once the rail 12 has been nested in the bracket 14, the rail may be secured to the bracket 14. In the embodiments of FIGS. 1–3, this may be accomplished by attaching a connector, such as a screw through the opening 24 in the side support 20 of the bracket 14. It will be appreciated that many alternative structures can be used to secure the rail 12 to the bracket 14, and that such structures are within the scope of the present invention.

Once the rail 12 has been secured, a cover 16, also sometimes referred to herein as "trim", may be used to conceal the connector used to secure the rail 12 to the bracket 14. In such an embodiment, the cover 16 is first placed onto the rail 12 such as in the manner shown in FIG. 3, prior to the rail 12 being nested in the bracket 14. Once the rail 12 is nested within the bracket 14, the cover 16 is then slid along the rail 12 and over the bracket 14. The cover 16 may, if desired, be designed to attach to the bracket 14 by the interaction of cover projections 32 with receiving openings 26 located on the side wall 20 of the bracket 14. This is best shown in the embodiment of FIG. 2, which depicts a cover 16 in the installed position relative to the bracket 14. It will be appreciated that many alternative structures, readily ascertainable to those skilled in the art, can suffice to attach the cover 16 to the bracket 14, and that such structures are within the scope of the present invention.

By providing a bracket 14 attached to a post 10, in which the rail 12 may be nested prior to securing the rail 12 to the bracket 14, the present invention accomplishes the object of holding the rail 12 during the attachment of the rail 12 to the post 10 in a fence system. This provides an advantage over the prior art, in which the rail must be supported by some means other than the bracket during the installation procedure to attach the fence rail to the fence post. By supporting the rail 12 beneath its lowest portion, the system allows the rail 12 to span the length of the space between the posts and have support that is less likely to weaken the rail. This is an advantage over the device disclosed in the '671 patent, described in the background section above, which requires the rail 12 to be shorter than the space between the posts, so that internal supports may be inserted into the rail. The present invention also avoids focusing the stress on the internal surface of the top wall of a hollow rail, and allows the system to be used with a solid rail 12 (as represented in FIG. 1.), both of which are advantages over the '671 patent. The rail 12 of the embodiments of FIGS. 2, 3 and 4 are hollow, illustrating the versatility of the invention.

Figure 4:
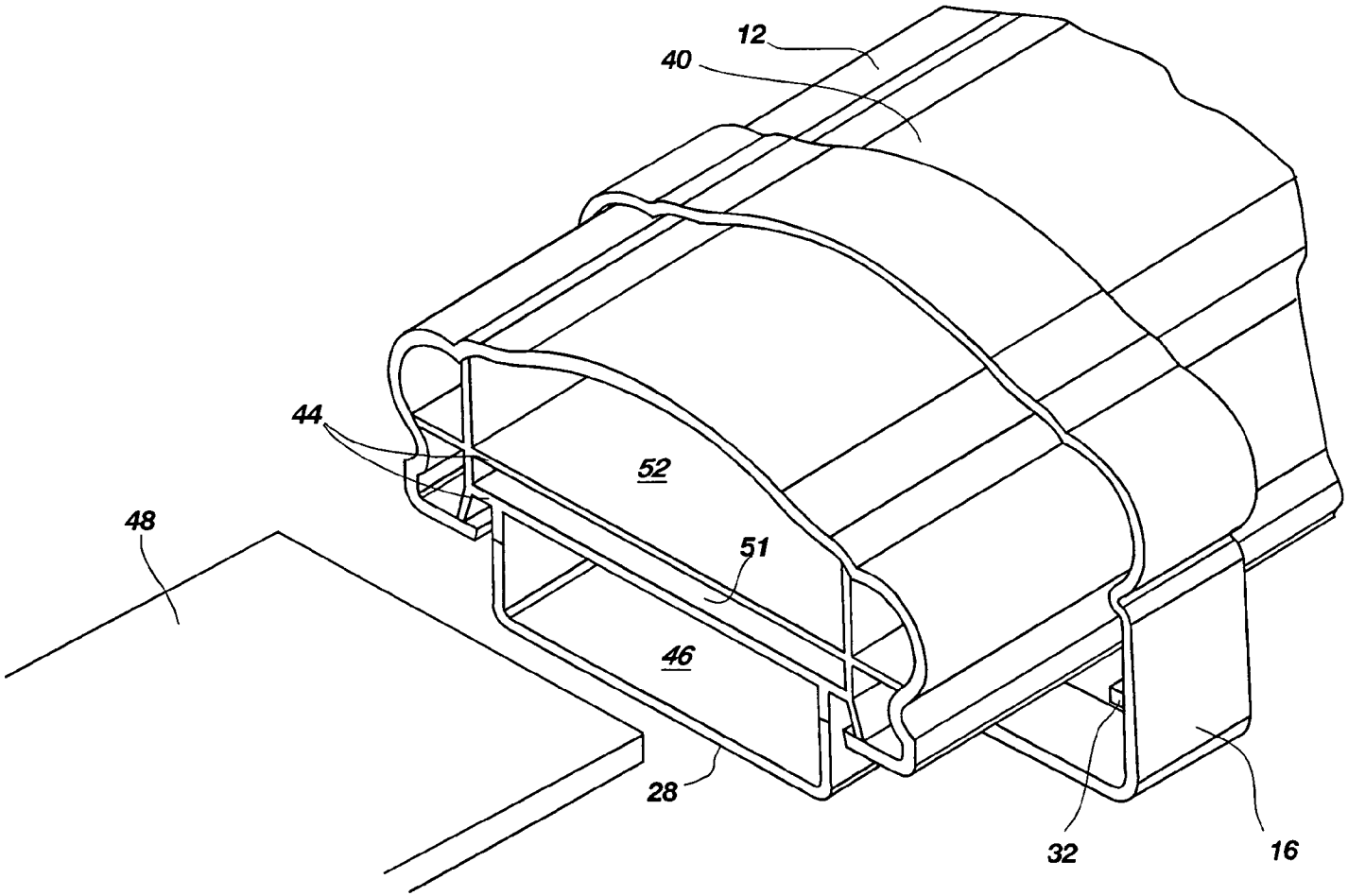
FIG. 4 is a perspective, break away view of another embodiment of the rail bracket mounting system of FIG. 3.

Referring now to FIG. 4, there is shown an alternative structure for the rail 12, which may be used in an embodiment of the present invention. Unlike the rail 12 of FIG. 2, which may be solid in construction, rail 12 is hollow. Preferably, rail 12 is constructed of PVC and is used as part of a PVC picket fence system, although it may be constructed of any suitable material. Rail 12 has a decorative top portion, generally indicated at 42, and contains internal walls 44 which divide the hollow interior. Reinforcement cavities 46, 51 and 52 are contained within the rail 40. The reinforcement cavities are defined by the bottom wall 49 of the rail 40 and internal walls 44. It will be appreciated that a reinforcement cavity may comprise the entire interior or there may be a plurality of reinforcement cavities as shown to provide additional reinforcement. A reinforcement member 48 may be inserted into the cavity 46. The reinforcement member 48 is preferably formed to fill the entire reenforcement cavity 46, but need not do so. The reinforcement member 48 may be constructed of any material capable of giving additional strength to the rail 12. The preferred materials for the reinforcement member 48 are steel and aluminum. The reinforcement member 48 may extend the entire length of the rail 12. FIG. 1 also shows reinforcement cavities 46, 51 and 52.

By using a rail 12 that is reinforced throughout its length, in a mounting system such as that in FIG. 2, 3 or 4, the invention combines the advantages of a reinforced rail, with the advantages of a nesting mounting system.

In accordance with the features and combinations described above, one preferred method of attaching members in a fence system comprising upwardly-extending fence posts and laterally-extending fence rails includes the steps of:

(a) selecting a first non-metallic fence bracket configured to be attached to a fence post that is upwardly-extending in orientation, the first non-metallic bracket further comprising at least a first ledge and at least two sides;

the ledge disposed to reside beneath the lowest point of a laterally-extending fence rail inserted into said first non-metallic bracket, each side disposed to support at least a portion of a side of said rail;

such that said first non-metallic bracket is capable of supporting the rail when an end of the rail is inserted therein;

(b) attaching the bracket to the post;

(c) selecting a fence rail and placing a first end of the rail into the non-metallic bracket, such that the rail is supported by the non-metallic bracket; and (d) securing the rail to the bracket.

It is further preferred to practice this method by attaching a second non-metallic bracket to a second post and insert the second end of the rail into the second non-metallic bracket, such that the rail is entirely supported by the first and second non-metallic brackets, then securing the rail to the first and second non-metallic brackets.

Also in accordance with the features and combinations described above, another preferred method of attaching members in fence system comprising upwardly-extending fence posts and laterally-extending fence rails includes the steps of:

(a) selecting a first bracket configured to be attached to a fence post that is upwardly-extending in orientation, the first bracket further comprising at least a first ledge and at least two sides;

the ledge disposed to reside beneath the lowest point of a first end of a laterally-extending fence rail inserted into said first bracket, each side disposed to support at least a portion of a side of one end of said rail;

such that said first bracket is capable of supporting the rail when an end of the rail is inserted therein;

(b) attaching the first bracket to the post;

(c) selecting a fence rail and placing a first end of the rail into the first bracket, such that the rail is supported by the first bracket;

(d) securing the rail to the first bracket;

(e) selecting a bracket cover designed and configured to attach to the first bracket and conceal the attachment of the rail to the first bracket, said cover comprising at least one fastening structure, such that when the cover is attached to the bracket, the fastening structure interacts with the receiving structure to secure the cover to the bracket; and (f) attaching the cover to the first bracket.

In a more preferred embodiment, this method further comprises attaching a second bracket to a second post, and inserting the second end of the rail into the second bracket, such that the rail is entirely supported by the first and second, then securing the rail to the first and second brackets, and selecting and attaching a second bracket cover to the second bracket.

It will be appreciated that the structures and methods included in the present invention thus provide a rail bracket mounting system that is simple in design and operation and is capable of being used with a hollow rail or a solid rail. It will be further appreciated that certain embodiments of the present invention provide a rail bracket mounting system that supports the rail during attachment so the rail may be secured without separate support and some embodiments of the present invention provide such a rail bracket mounting system that provides a means to guide a rail into alignment with the post.

It will also be appreciated that the present invention, in some embodiments provides a support means that resides below the lowest portion of the rail. Other embodiments provide a means by which a hollow rail may be reinforced along its entire length. It will also be appreciated that the present invention, in accordance with one aspect thereof, provides a rail bracket mounting system in which the securing fasteners are not exposed.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

Figure 5:
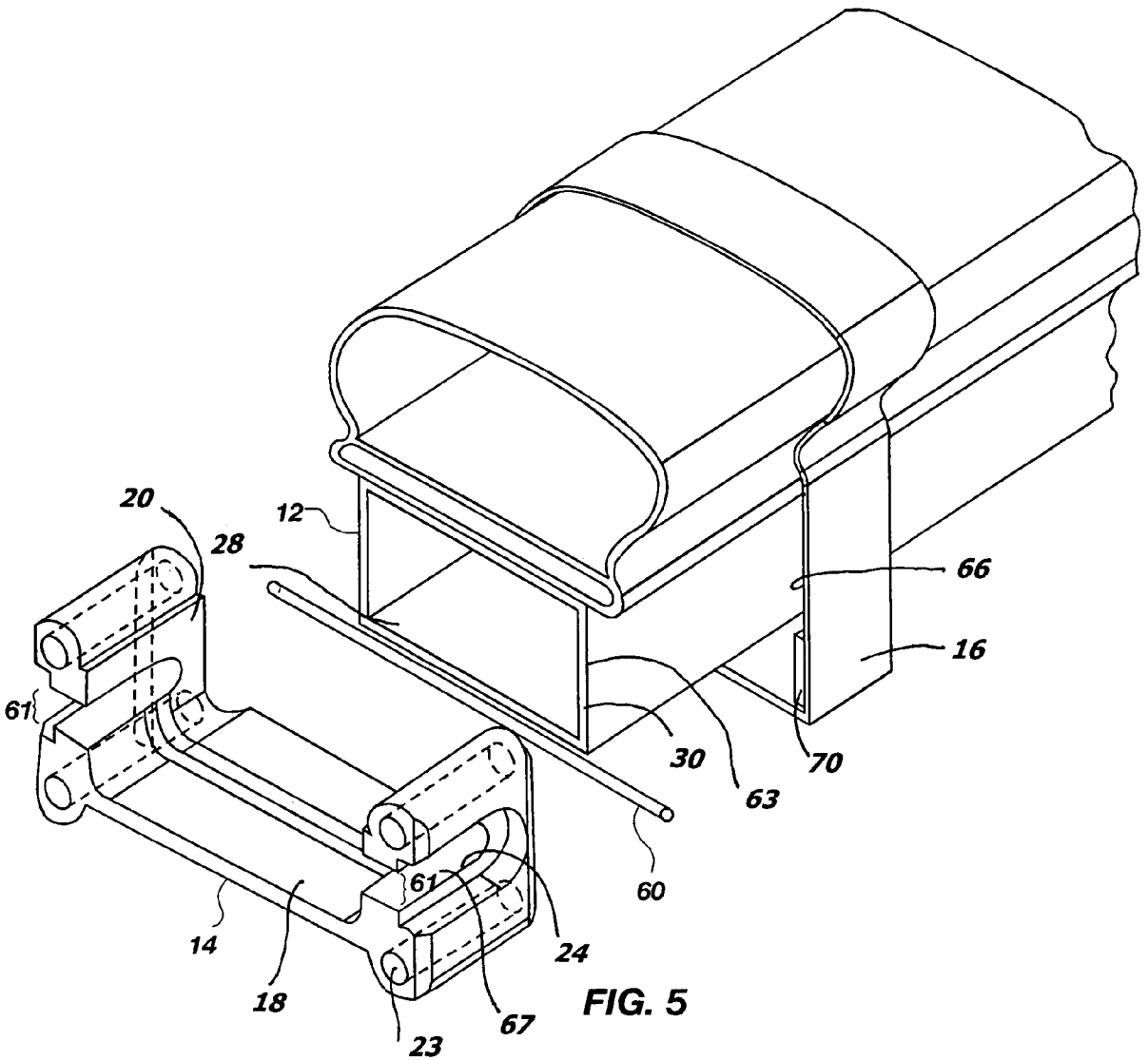
FIG. 5 is an exploded perspective view of another embodiment of the rail bracket mounting system of FIG. 1.

Referring now to FIG. 5, there is shown a perspective view of an alternative embodiment of the fastener used to attach the rail 12 to the bracket 14. The rail 12 and bracket 14 shown in FIG. 5 are substantially the same as the embodiment of FIG. 2, with the exception that the bracket 14 in FIG. 5 has slot openings 61 formed in the bracket 14. In this embodiment, a pin 60 acts as the fastener that extends through the holes 62 of fence rail 12 to attach the rail 12 to the bracket 14 by engagement of the pin 60 against the bracket edges that form the opening 24. The pin 60 may comprise a 3/16 inch stainless steel rod, but may also be constructed of any suitable material known to those skilled in the art. It will be appreciated that the pin 60 can be used as a fastener in all of the various embodiments of the invention, and may have a smooth exterior surface characterized by an absence of threads.

Figure 6:
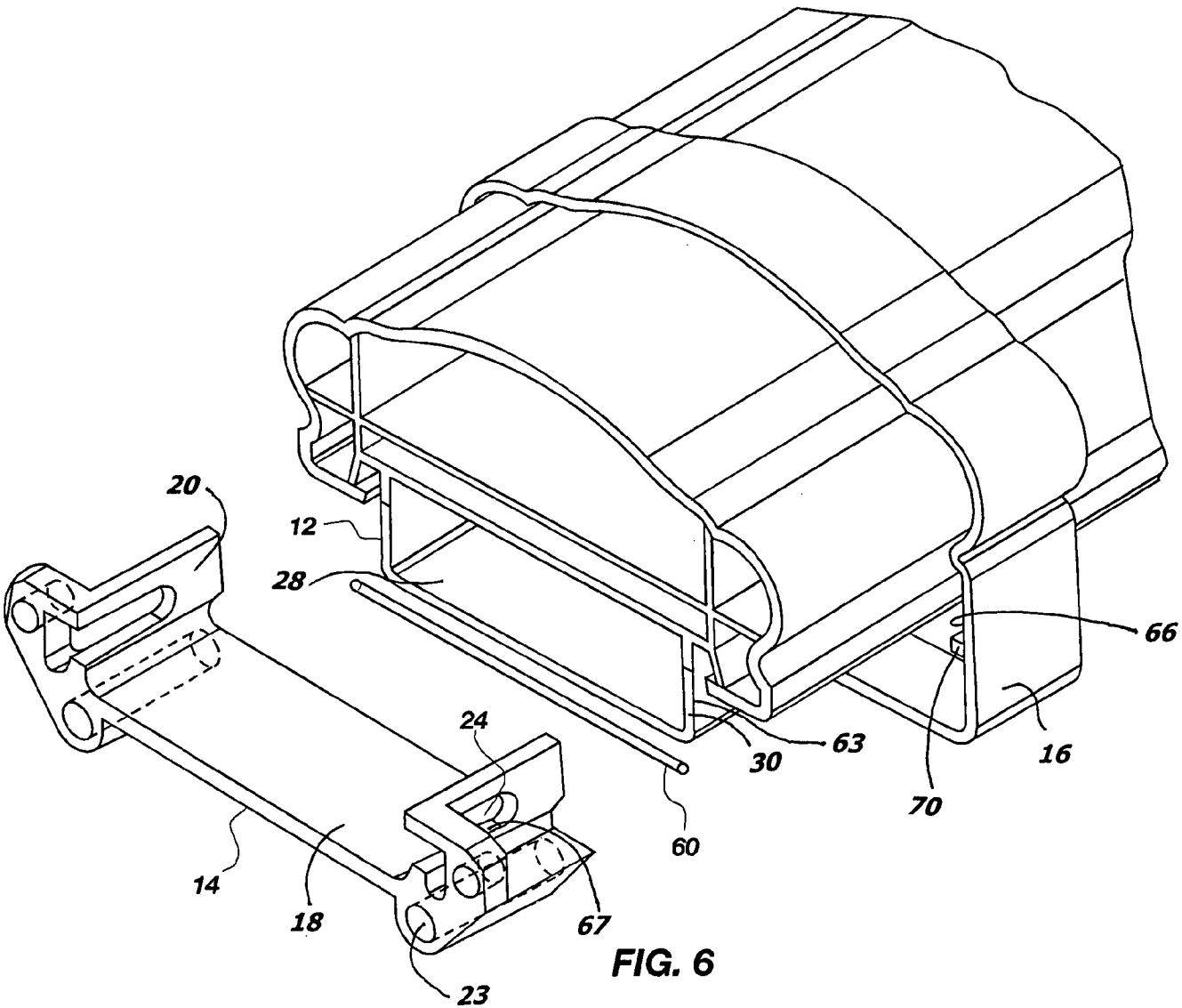
FIG. 6 is an exploded perspective view of another embodiment of the rail bracket mounting system of FIG. 3.

Referring now to FIG. 6, there is shown a perspective view of the rail 12 and bracket 14 embodiment of FIG. 3, with the addition of a pin 60, wherein the pin 60 is used to attach the rail 12 to the bracket 14. The embodiment in FIG. 6 has substantially the same bracket 14 as the embodiment of FIG. 3, with the exception that the opening 24 in the bracket 14 of the embodiment in FIG. 6 is a different shape than the opening 24 in the bracket 14 in the embodiment shown in FIG. 3.

Figure 7:
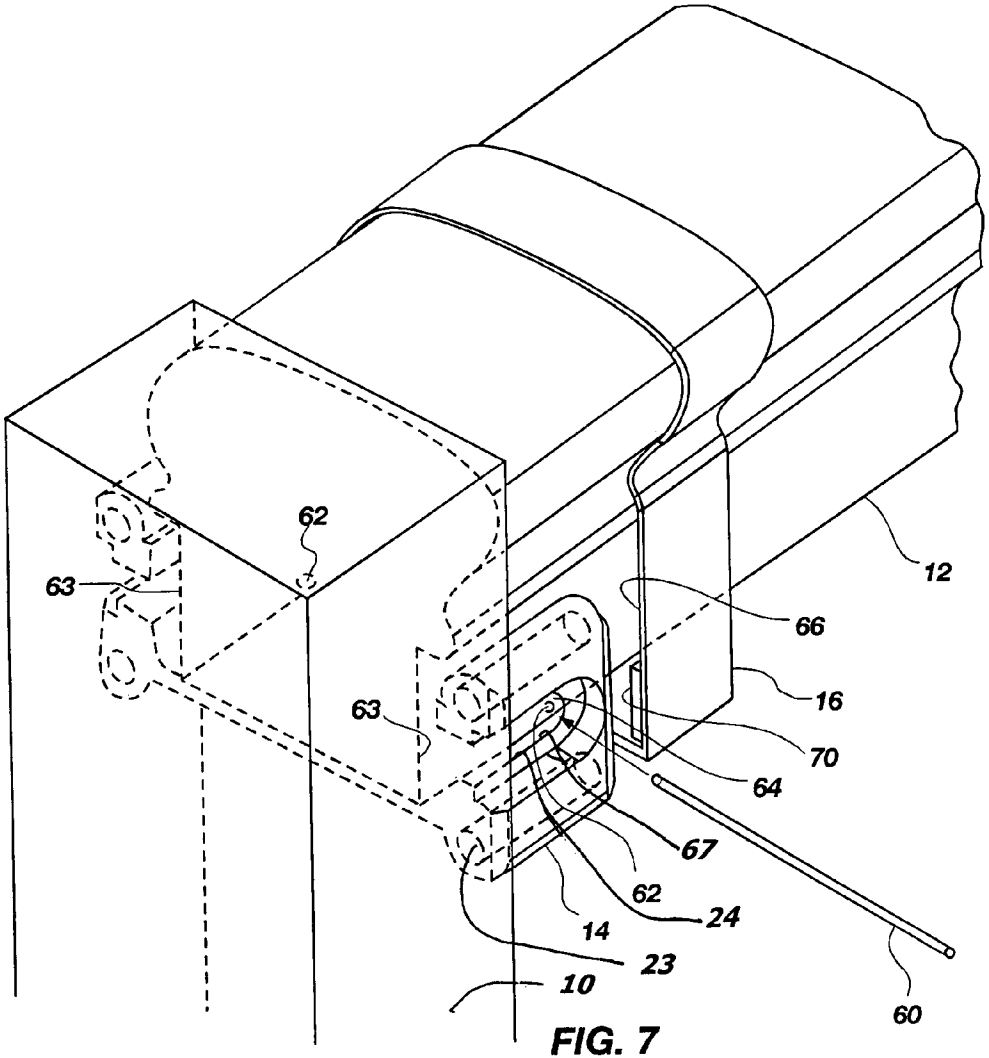
FIG. 7 shows the system of FIG. 5 in a partially assembled arrangement.

Referring now to FIG. 7, there is shown a perspective view of the pin 60 being inserted into the rail 12 and bracket 14 of the embodiment shown in FIG. 5. The rail 12 is inserted and nested into the bracket 14 in the same manner as described previously. In this embodiment, the rail 12 is attached to the bracket 14 in the following manner. A hole 62 is preferably drilled into a side of the rail 12, preferably a hollow rail 12, by the person installing the fence at the fence assembly site. Preferably, the hole 62 is located 1/8 inch from the bracket 14 as indicated in FIG. 7 by the space designated as reference numeral 64. A second hole 62 is then drilled into the opposite side of the rail in the same manner as the first hole 62. It will be appreciated to those skilled in the art that the pin 60 could also be attached in any other suitable manner. The ⅛ inch space accommodates expansion and contraction of the material used to construct the rail 12 and bracket 14. The pin 60 provides an advantage over a screw fastener because the smooth surface of the pin 60 will not cut into the material used to construct the rail 12 like the sharp edges of a screw. Repeated contraction and expansion of the rail 12 causes the sharp edges of a screw to form a stress point, which over time can cause the rail 12 to fail.

Referring again to FIG. 7, the pin 60 is held into place by the cover 16, after the cover 16 is snapped into place onto the bracket 14 with interference tabs 70. Preferably, the pin 60 is of a length substantially the same distance as the width between the two inside edges 66 of the cover 16. The length of the pin 60 allows the two ends of the pin 60 to extend past the two outer edges 63 of the rail 12 and contact the inside edges 67 of the bracket 14 to prevent the rail 12 from sliding out of the bracket 14. Once the pin 60 has been inserted into the rail 12, the cover 16 is slid into place. The inside edges 66 of the cover 16 prevents the pin 60 from sliding out of the rail 12.

The use of the pin 60 to secure the rail 12 to the bracket 14 provides the fence installer with more versatility. For instance, the use of the pin 60 makes attachment of a rail 12 to a bracket 14 easier when the rail 12 is being installed at an angle, such as on a stairway where the rail 12 is attached to the bracket 14 at an angle.

The term "intercoupling" as used herein, such as in the phrase "intercoupling means for intercoupling the fence rail and said fence rail support," shall be construed broadly to refer to any means or method of providing a mechanical contact connection between at least two members, regardless of whether said connection is an interference fit connection, or a frictional connection, or some other contact connection. For example, the rail bracket operates to intercouple the fence rail to the fence post, with or without the pin member or snap-on trim, simply by being attached to the fence post and serving as a type of tray on which the fence rail may rest. Therefore, even though the fence rail may be easily lifted off of the rail bracket if the pin member and snap-on trim are not used, the bracket nonetheless operates to intercouple the fence rail to the fence post by supporting the rail in the manner of a type of tray connected to the post.

From the descriptions above, it will be appreciated that one feature of the present invention is to provide a rail bracket mounting system that is simple in design and operation.

It is another feature of the present invention, in accordance with one aspect thereof, to provide a rail bracket mounting system that supports the rail during attachment, such that the rail may be secured without separate support.

It is another feature of the present invention, in accordance with one aspect thereof, to provide such a rail bracket mounting system that includes a means to guide a rail into alignment with the post.

It is a further feature of the present invention, in accordance with one aspect thereof, to provide a support means that resides below the lowest portion of the rail.

It is an additional feature of the invention, in accordance with one aspect thereof, to provide a rail bracket mounting system capable of being used with either a hollow rail or a solid rail.

It is also a feature of the invention, in accordance with one aspect thereof, to provide a means by which a hollow rail may be reinforced along its entire length.

It is another feature of the invention, in accordance with one aspect thereof, to provide a rail bracket mounting system in which the securing fasteners are not exposed.

Additional features and advantages of the invention have either been set forth in the foregoing description or are apparent from it, or may be learned by the practice of the invention without undue experimentation. The features and advantages of the invention may be realized and obtained by means of the instruments and combinations particularly pointed out in the appended claims.

What is claimed is:

1. A fence-rail securing assembly for securing a fence rail to a fence rail support, said securing assembly comprising:

a bracket member configured and adapted to be attached to a first side of the rail support for receiving a free end of the rail thereupon such that a portion of the bracket member resides beneath a lower side of the rail and such that said free end of the rail faces said first side of the rail support, and said bracket member is open such that an upper side of the rail is free from being bounded by said bracket member; and a securing means for securing the rail to the bracket member, wherein said securing means comprises a pin member that is slidable through a plurality of openings formed in the bracket member and also through a plurality of openings in the rail, when said openings in the bracket member and rail are all disposed in alignment with one another, said pin member being characterized by an absence of male threads formed thereon;

wherein the bracket member comprises side supports; and wherein said side supports each comprise a contacting face configured and positioned to face the first side of the rail support when the bracket member is attached to the rail support and the rail is secured to the bracket member, and wherein said side supports further comprise a plurality of through-bores extending through said contacting face to thereby face the first side of the rail support when the bracket member is attached to said rail support, for receiving fasteners to attach said bracket member to said fence rail support.

2. The fence rail securing assembly of claim 1, wherein the securing means consists essentially of a single pin member.

3. The fence-rail securing assembly of claim 1, wherein said plurality of through-bores are configured to be oriented in a direction substantially parallel to said fence rail.

4. The fence-rail securing assembly of claim 1, wherein said pin member is configured to be received in said plurality of openings simultaneously.

5. A fence-rail securing assembly for securing a fence rail to a fence rail support, said securing assembly comprising:

an intercoupling means attachable to the fence rail support for intercoupling the fence rail and said fence rail support; and a single pin member configured and dimensioned for being slidably inserted into, and residing within, at least two openings formed in the fence rail and at least two openings formed in the intercoupling means, simultaneously, to thereby block movement of the fence rail in at least a first direction with respect to the intercoupling means; and a cover configured for concealing the intercoupling means and pin member when the fence rail is secured to the fence rail support.

6. The fence-rail securing assembly of claim 5, wherein the intercoupling means comprises a bracket member having two side supports.

7. The fence-rail securing assembly of claim 6, wherein said side supports comprise a plurality of through-bores for receiving fasteners to attach said bracket member to said fence rail support.

8. The fence-rail securing assembly of claim 7, wherein said plurality of through-bores are configured to be oriented in a direction substantially parallel to said fence rail.

9. The fence-rail securing assembly of claim 6, wherein said cover comprises tabs for connecting said cover to said bracket member.

10. The fence-rail securing assembly of claim 5, wherein said cover comprises two inside edges separated by a width, and wherein the pin member has a length that is substantially equal to the width between the two inside edges.

11. A fence-rail securing assembly for securing a fence rail to a fence rail support, said securing assembly comprising:

a bracket means attachable to the fence rail support for supporting one end of a fence rail in a suspended position and allowing said fence rail to be lifted off said bracket means in an upward direction without movement of said fence rail in a direction along a longitudinal axis of said fence rail; and a blocking means for being inserted into and extending through a width of the fence rail, such that opposing ends of said blocking means protrude from separate opposing peripheral sides of said fence rail, respectively, and reside between the fence rail support and at least a portion of the bracket means, to thereby block removal of the fence rail from the bracket means;

wherein said blocking means comprises a pin; and wherein said bracket means comprises elongate slot openings for receiving said blocking means and for allowing movement of said blocking means along said openings.

12. The fence-rail securing assembly of claim 11, wherein the pin is constructed from metal.

13. The fence-rail securing assembly of claim 11, wherein the pin is constructed from stainless steel.

14. The fence-rail securing assembly of claim 11, wherein the pin is 3/16 of an inch in diameter.

15. The fence-rail securing assembly of claim 11, further comprising a retaining means for retaining the blocking means in position within the fence rail.

16. A fence-rail securing assembly for securing a fence rail to a fence rail support, said securing assembly comprising:

a bracket means attachable to the fence rail support for supporting one end of a fence rail in a suspended position and allowing said fence rail to be lifted off said bracket means in an upward direction without movement of said fence rail in a direction along a longitudinal axis of said fence rail; and a blocking means for being inserted into and extending through a width of the fence rail, such that opposing ends of said blocking means protrude from opposing sides of said fence rail, respectively, and reside between the fence rail support and at least a portion of the bracket means, to thereby block removal of the fence rail from the bracket means;

said securing assembly further comprising a retaining means for retaining the blocking means in position within the fence rail;

wherein the retaining means comprises a cover configured and dimensioned to slidably circumscribe the fence rail; and wherein said blocking means comprises a pin.

17. The fence-rail securing assembly of claim 16, wherein the retaining means circumscribes the bracket means and the fence rail when disposed in position to retain the blocking means.

18. A fence system including a securing assembly for securing a fence rail to a fence rail support, said securing assembly comprising:

a bracket means attachable to the fence rail support for supporting one end of a fence rail in a suspended position and allowing said fence rail to be lifted off said bracket means in an upward direction without movement of said fence rail in a direction along a longitudinal axis of said fence rail; and a blocking means for being inserted into and extending through a width of the fence rail, such that opposing ends of said blocking means protrude from separate opposing peripheral sides of said fence rail, respectively, and reside between the fence rail support and at least a portion of the bracket means, to thereby block removal of the fence rail from the bracket means;

wherein said bracket means comprises elongate slot openings for receiving said blocking means and for allowing movement of said blocking means along said openings.

19. The fence system of claim 18, wherein the blocking means comprises a pin.

20. The fence system of claim 19, wherein the pin is constructed from metal.

21. The fence system of claim 19, wherein the pin is constructed from stainless steel.

22. The fence system of claim 19, wherein the pin is 3/16 of an inch in diameter.

23. The fence system of claim 18, further comprising a retaining means for retaining the blocking means in position within the fence rail.

24. A fence-rail securing assembly for securing a fence rail to a fence rail support, said securing assembly comprising:

a bracket member configured and adapted to be attached to the rail support for receiving a free end of the rail;

a pin member for securing the rail to the bracket member; and a cover configured for concealing the bracket member and pin member when the fence rail is secured to the fence rail support;

wherein said cover comprises two inside edges separated by a width, and wherein the pin member has a length that is substantially equal to the width between the two inside edges.

25. The fence-rail securing assembly of claim 24, wherein the bracket member comprises two side supports.

26. The fence-rail securing assembly of claim 25, wherein each of said side supports comprises an opening for receiving said pin member.

27. The fence-rail securing assembly of claim 26, wherein said pin member is configured to be received in both of said openings in said side supports simultaneously.

28. The fence-rail securing assembly of claim 24, wherein said cover comprises tabs for connecting to said bracket member.

29. The fence-rail securing assembly of claim 24, wherein the bracket member comprises a bottom ledge for supporting said rail thereon.

30. The fence-rail securing assembly of claim 24, wherein said pin member is dimensioned to span a width of said bracket member.

31. A fence-rail securing assembly for securing a fence rail to a fence rail support, said securing assembly comprising:

a bracket member configured and adapted to be attached to the rail support for receiving a free end of the rail thereupon such that a portion of the bracket member resides beneath a lower side of the rail;

a securing means for securing the rail to the bracket member, wherein said securing means comprises a pin member that is slidable through a plurality of openings formed in the bracket member and also through a plurality of openings in the rail, when said openings in the bracket member and rail are all disposed in alignment with one another, said pin member being characterized by an absence of male threads formed thereon; and a cover configured for concealing the bracket member and pin member when the fence rail is secured to the fence rail support.

32. The fence-rail securing assembly of claim 31, wherein said cover comprises two inside edges separated by a width, and wherein the pin member has a length that is substantially equal to the width between the two inside edges.

33. The fence-rail securing assembly of claim 31, wherein said cover comprises tabs for connecting said cover to said bracket member.

34. A fence system including a securing assembly for securing a fence rail to a fence rail support, said securing assembly comprising:

a bracket means attachable to the fence rail support for supporting one end of a fence rail in a suspended position and allowing said fence rail to be lifted off said bracket means in an upward direction without movement of said fence rail in a direction along a longitudinal axis of said fence rail; and a blocking means for being inserted into and extending through a width of the fence rail, such that opposing ends of said blocking means protrude from opposing sides of said fence rail, respectively, and reside between the fence rail support and at least a portion of the bracket means, to thereby block removal of the fence rail from the bracket means;

wherein the fence system further comprises a retaining means for retaining the blocking means in position within the fence rail; and wherein the retaining means comprises a cover configured and dimensioned to slidably circumscribe the fence rail.

35. The fence system of claim 34, wherein the retaining means circumscribes the bracket means and the fence rail when disposed in position to retain the blocking means.

36. A fence-rail securing assembly for securing a fence rail to an upwardly extending fence rail support, said securing assembly comprising:

a bracket member configured and adapted to be attached to the fence rail support for receiving a free end of the fence rail;

a pin member for securing the fence rail to the bracket member; and a cover configured for concealing the bracket member and pin member when the fence rail is secured to the fence rail support;

wherein the bracket member comprises two side supports;

wherein each of said side supports comprises an opening for receiving said pin member;

wherein said openings in said side supports are configured as oblong slots for allowing movement of said pin member along said openings;

wherein said pin member is configured and is of a dimension to be received in both of said openings in said side supports simultaneously;

wherein said cover comprises two inside edges separated by a width, and wherein the pin member has a length that is no longer than the width between the two inside edges;

wherein said cover comprises tabs for connecting said cover to said bracket member;

wherein said cover is configured and dimensioned to slidably circumscribe the fence rail;

wherein the bracket member comprises a bottom ledge extending between said two side supports, said bottom ledge being configured for supporting said fence rail thereon such that said bottom ledge resides beneath a lower side of the fence rail;

wherein said side supports comprise a plurality of through-bores for receiving fasteners to attach said bracket member to said fence rail support;

wherein said plurality of through-bores are configured to be oriented in a direction substantially parallel to said fence rail;

wherein said pin member is constructed from metal;

wherein said pin member is substantially straight having a uniform thickness along a majority length thereof;

wherein said pin member is configured as a smooth rod, characterized by an absence of threads;

wherein said pin member is configured to be slidably inserted through at least two openings in said fence rail and said openings in said side supports, such that said pin member is configured to reside in all four openings simultaneously to secure said fence rail to said bracket member.

* * * * *